United States Patent [19]

Schirtzinger

[11] 4,045,967

[45] Sept. 6, 1977

[54] APPARATUS FOR SUPPORTING A DRILLING PLATFORM ON THE OCEAN FLOOR

[75] Inventor: Joseph F. Schirtzinger, Pasadena, Calif.

[73] Assignee: Sea-Log Corporation, Pasadena, Calif.

[21] Appl. No.: 658,224

[22] Filed: Feb. 17, 1976

Related U.S. Application Data

[63] Continuation-in-part of Ser. No. 458,986, April 8, 1974, Pat. No. 3,996,756.

[51] Int. Cl.[2] ..... E02B 17/00; E02D 27/04

[52] U.S. Cl. ..... 61/86; 61/93; 175/9

[58] Field of Search ..... 61/46.5, 46, 50, 7, 61/82; 175/9

[56] References Cited

U.S. PATENT DOCUMENTS

| | | | |
|---|---|---|---|
| 2,669,846 | 2/1954 | Shannon | 61/88 |
| 3,522,709 | 8/1970 | Vilain | 61/95 |

*Primary Examiner*—Jacob Shapiro

*Attorney, Agent, or Firm*—Christie, Parker & Hale

[57] ABSTRACT

A mounting structure for supporting a drilling platform on the ocean floor comprises an open precast vessel having a bottom wall and a side wall extending up from and around the perimeter of the bottom wall which is adapted to be recessed in the ocean floor at the drilling site. A monopod drilling structure having a base and a supporting column extending upwardly from the base to a drilling platform is positioned on top of the vessel with the bottom of the supporting column having a vertical passage opening through the bottom of the base into the vessel. Sealing means is provided between the top of the vessel and the bottom of the drilling structure which provides a water-tight seal, permitting the interior of the vessel to be pumped dry when the drilling structure is in place.

4 Claims, 12 Drawing Figures

PIPELINE LAID FROM DRILLING SITE TO TERMINAL PIPE

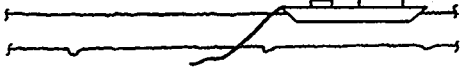

Fig. 4

DREDGE REMOVES ROCKS AND LARGE DEBRIS BELOW MUDLINE IN AREA CENTERED ON DRILL SITE; THEN DREDGES AREA BELOW MUDLINE.

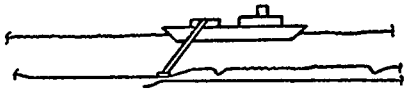

Fig. 5

DRILLING CELLAR - WITH TEMPORARY TOP COVER — TOWED TO SITE.

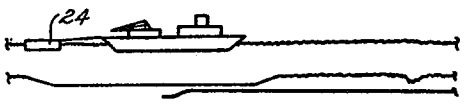

Fig. 6

A) CRANE REMOVES TOP COVER FROM CELLAR AND MAKES FAST TO CELLAR.

B) HIGH PRESSURE WATER LINES FOR WATER JETS CONNECTED.

C) WATER PUMPED INTO CELLAR - SUSPENDED FROM CRANE.

D) CELLAR LOWERED INTO BOTTOM AT SITE - NEAR END OF PIPELINE — USING WATER JETS. LEVEL EMPLACEMENT INSURED BY MESSENGER LINE GAUGES AND DIFFERENTIAL WATER JET CONTROL.

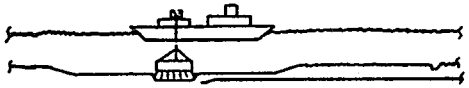

Fig. 7

A) CELLAR IN PLACE, WITH TOP AT LEVEL OF DREDGED AREA.

B) MUD INSIDE OF CELLAR REMOVED.

C) DREDGED AREA SMOOTHED OVER IN VICINITY OF CELLAR, TO PRIOR DREDGED LEVEL.

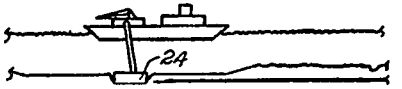

Fig. 8

PIPELINE INSTALLED INTO CELLAR AREA.

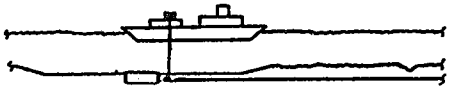

Fig. 9

Fig. 11
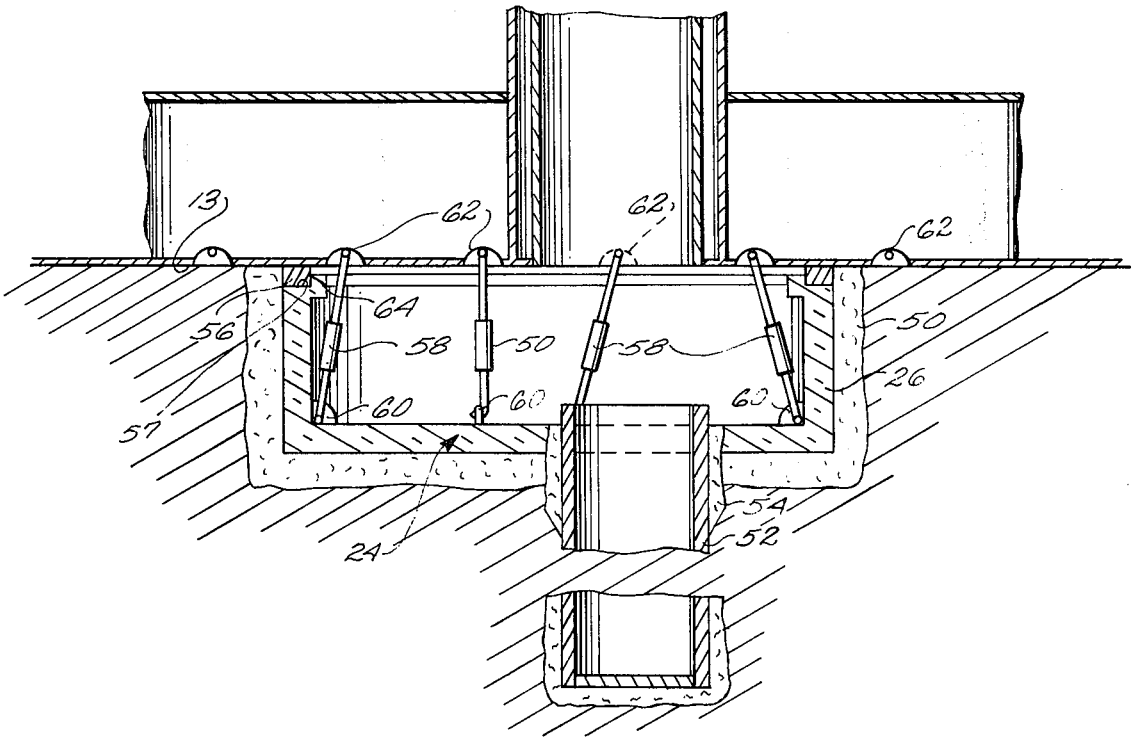
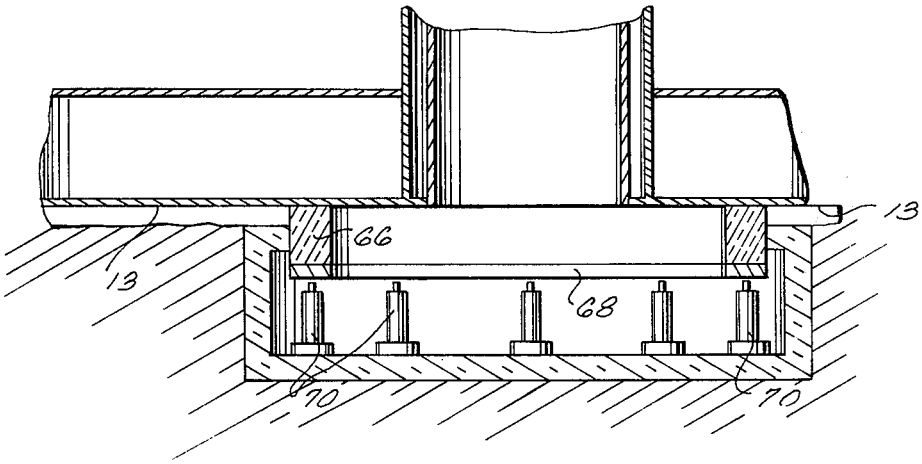
Fig. 12

APPARATUS FOR SUPPORTING A DRILLING PLATFORM ON THE OCEAN FLOOR

RELATED CASES

This application is a continuation-in-part of copending application Ser. No. 458,986, filed Apr. 8, 1974 now Pat. No. 3,996,756.

FIELD OF THE INVENTION

This invention relates to subsea drilling platforms, and more particularly, to apparatus for supporting a monopod drilling platform on the ocean floor.

BACKGROUND OF THE INVENTION

With the increased interest in offshore oil production in the icy waters of the arctic, there has developed a need for more mobile drilling platforms which can be readily moved during severe ice conditions but which can operate in the presence of surface ice. A monopod platform with icebreaking capability has advantages over more conventional drilling platforms for this type of operation. While the monopod type platform can be operated as a semisubmersible, in shallower waters, it is preferable to anchor the platform directly on the ocean bottom. The monopod structure with its flat-bottom lower hull, presents a problem when used for drilling and completing a plurality of development wells at close locations, since room must be provided for mounting the "christmas tree" and other equipment on top of the well after it is drilled and before moving the platform to the next drilling location.

SUMMARY OF THE INVENTION

The present invention is directed to apparatus for anchoring a drilling platform to the ocean floor for completion of multiple production wells. In brief, the present invention utilizes a precast cellar having a flat bottom wall and upstanding sidewalls, the cellar being open at the top. After dredging the ocean floor to provide a level area larger than the bottom of the drilling platform, the cellar structure is lowered by a surface vessel to the center of the leveled area. Fluid jets are provided in the bottom wall of the cellar which are connected to a source of fluid under pressure. The downwardly directed fluid jets remove material from beneath the bottom of the cellar structure, permitting it to bury itself in the ocean floor so as to be depressed below the level of support of the drilling platform on the ocean floor. Means is provided for joining the base of the platform to the cellar structure and forming a water-tight seal between the cellar and the platform. The interior of the cellar can then be pumped dry so as to be accessible to workmen through the center of the monopod platform column.

Description of the Drawings

For a more complete understanding of the invention, reference should be made to the accompanying drawings, wherein:

FIGS. 4–9 illustrate the operating sequence in placing the cellar structure at the drill site;

FIGS. 11 and 12 are cross-sectional views of alternative arrangements for anchoring and sealing a monopod drilling platform to the ocean floor.

DETAILED DESCRIPTION

Figure 1:
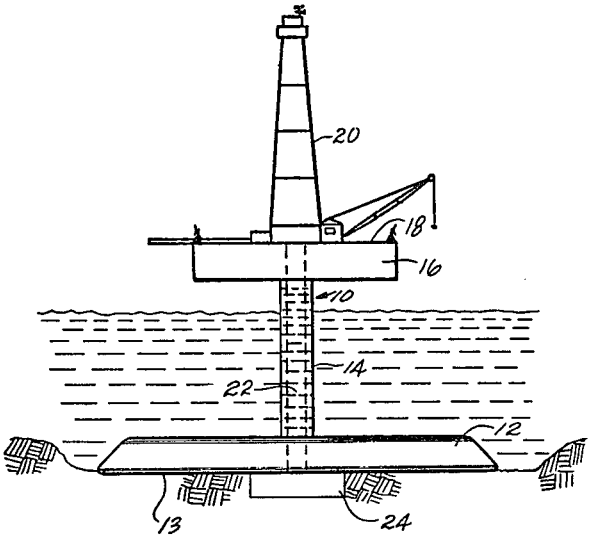
FIG. 1 is a side elevational view of the drilling platform in operative position on the ocean floor.

Referring to FIG. 1, the numeral 10 indicates generally a monopod type drilling platform having a lower submerged hull 12, a vertical supporting column 14, and upper hull 16. The upper hull 16 includes a drilling deck 18 on which is supported a conventional drilling derrick 20. The drilling takes place through an open shaft or moon pool 22 extending from the drilling deck 18 down through the bottom 13 of the lower hull 12. The moon pool provides access to the substrata by the drilling rig. The bottom 13 of the lower hull 12 is designed to rest on the ocean floor after proper site preparation, as hereinafter described, having an emplaced cellar 24.

Figure 3:
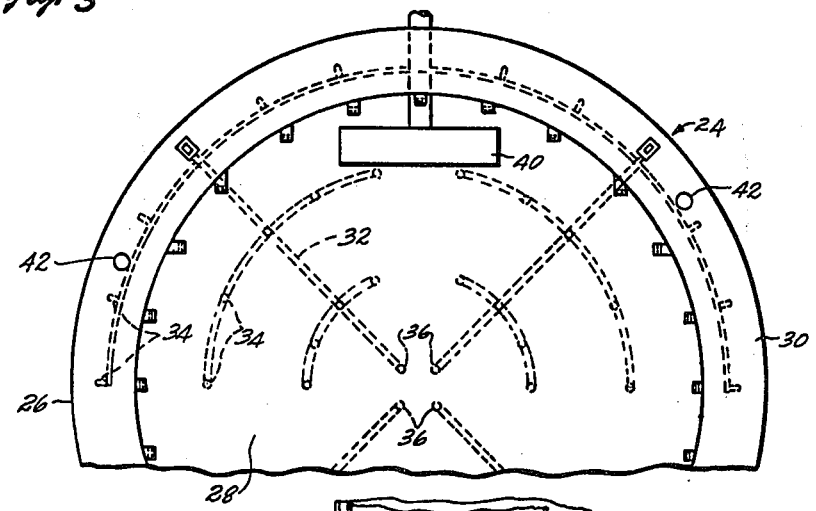
FIG. 3 is a top view of the cellar structure and the base of an associated monopod drilling platform.
Figure 2:
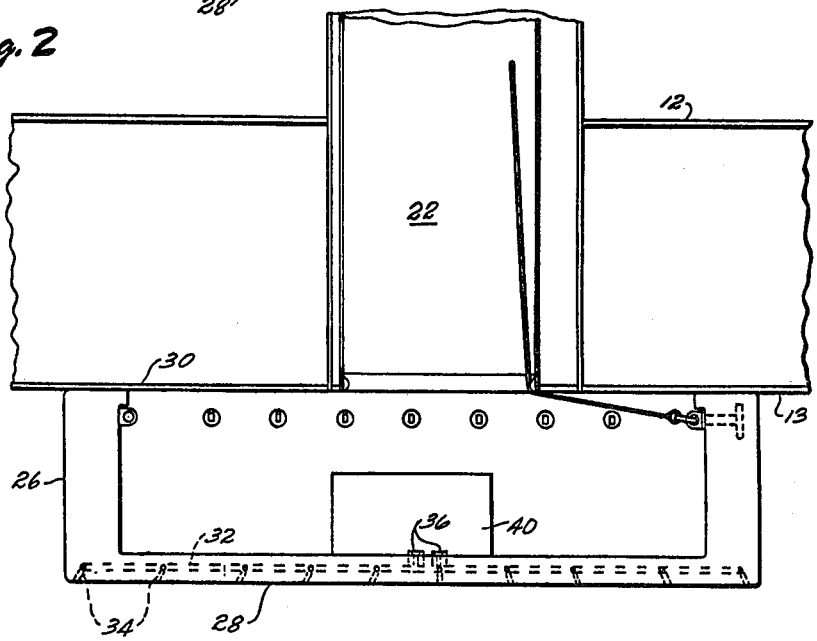
FIG. 2 is a cross-sectional view of the cellar structure.

Referring to FIGS. 2 and 3, the cellar 24 includes a cylindrical sidewall 26 and flat bottom wall 28. The cellar is preferably cast from concrete with relatively thick sidewalls terminating in a flat annular top surface 30. The bottom 13 of the lower hull 12 rests in part on the surface 30, as shown in FIG. 3.

The cellar is cast with a network of high-pressure water lines, indicated generally at 32, in the bottom wall 28 of the cellar. The network of high-pressure water lines supply water under pressure to a plurality of water jets 34 which direct water downwardly beneath the bottom wall 28. As best seen in FIG. 3, the pipe network is preferably arranged in quadrants, with each quadrant having its own input stab connector 36 extending vertically upwardly through the bottom wall 28 on the inside of the cellar 24. Each inlet connector is in turn connected to a series of radiating pipes, each of which in turn is connected to a pattern of jets. By connecting the inlets to a source of water under high pressure, the pattern of high-pressure jets on the bottom of the cellar can be used, as hereinafter described, to control the emplacement of the cellar on the ocean floor.

Referring to FIGS. 4 through 9, the steps required to prepare the drilling site for the monopod drilling platform and to emplace the cellar is shown in detail. As shown in FIG. 4, a surface ship or barge is moved to the drilling site, preferably during the summer when the area is free of ice. Initially a pipeline is laid extending from the drill site to an oil production collection terminal (not shown). The end of the pipeline is submerged below the mudline to a depth corresponding to the desired depth of the emplaced cellar structure. The pipe is submerged in the bottom of the ocean by dredging or otherwise excavating a trench. The balance of the pipeline need not be submerged to the same depth as the end of the pipeline.

Once the pipeline is in place, a dredging operation is performed from the ship 40, as shown in FIG. 5. The dredge removes rocks and large debris to a depth, for example, below any ice scored trenches in the ocean floor. The dredge is then used to level an area substantially greater than the area of the bottom of the drilling platform; for example, an area 300 ft. square is typical.

Once the site is prepared, the drilling cellar 24, with a temporary top cover to keep out water from the inside of the cellar so that it will float, is towed to the drill site.

With the drilling cellar positioned over the drill site, the cover is removed from the cellar and high-pressure water lines are connected to the stab connectors 36. The cellar is then flooded to cause it to sink, the cellar being suspended by a cable from a crane on the surface vessel. Water under high pressure is pumped through the water jets beneath the cellar, the jets displacing mud and sand immediately beneath the cellar, permitting the cellar to bury itself below the mud line. Gages for sensing the attitude of the cellar as it is lowered are attached to the cellar with signal lines going to the surface vessel, so that the attitude of the cellar can be continuously monitored. By controlling the water delivered to the respective quandrants of the jet system the emplaced cellar can be maintained level.

As shown in FIG. 8, once the cellar 24 is emplaced, with the top at the level of the dredged area, any mud or debris inside the cellar is pumped out and the dredged area is smoothed out around the outside of the cellar so that the top of the cellar is flush with the smoothed area on which the bottom of the monopod drilling structure is later rested. A pipeline is then coupled into the production pipe manifold within the cellar, the manifold being indicated at 40 in FIG. 3.

Figure 10:
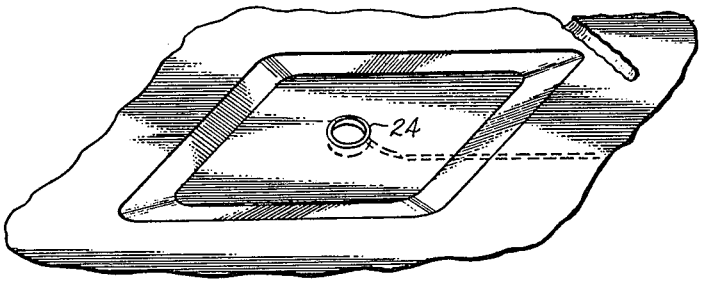
FIG. 10 is a perspective view of the drill site on the ocean floor.

As shown by the perspective view of FIG. 10, the completed drill site provides a depressed area which is sufficiently lower than the bottom of the ice-scored trenches to be relatively free from potential damage by surface ice. The cellar 24 is emplaced in the center of the recessed area and is connected to a pipeline going to a gathering point. The side is now ready for development whenever a monopod drilling structure of the type described in connection with FIG. 1 can be moved on location. The top 30 of the cellar sidewall 26 is preferably provided with sonar or other type of transponders, such as indicated at 42, which can be used to locate the cellar from the surface and can be used to guide the monopod drilling structure into position over the drill site. After the platform is positioned on the top of the cellar, as shown in FIG. 2, the lateral position of the platform can be adjusted relative to the cellar by means of a cable 44 extending down through the moon pool 22. The end of the cable 44 is attached to any one of a plurality of lugs 46 in the inside wall of the cellar 24. By applying tension to the cable the platform can be shifted in the manner described in detail in the above-identified patent. The positioning of the platform is described in detail in U.S. Pat. No. 3,871,184. The transponders transmit a signal back to the receiver on the platform on receiving a signal from the transmitter.

Referring to FIG. 11, there is shown an arrangement by which the bottom 13 of the monopod platform can be sealed to the cellar 24 so that the interior of the cellar can be pumped dry and opened to atmosphere through the moon pool of the platform. After the cellar 24 is imbedded in the ocean floor in the manner described above, cement 50 is squeezed between the outside of the cellar and the surrounding formation to anchor the cellar securely in place. The formation is then drilled into through the bottom of the cellar and the surface casing 52 is set and cemented in place, as indicated at 54. The upper end of the surface casing opens into the interior of the cellar.

The upper edge of the cellar is provided with a compressible seal 56 made of rubber or other suitable compressible material. The top of the cellar is provided with a recess 57 around the top edge which retains the annular seal 56. The seal is compressed by the weight of the drilling platform, the bottom 13 pressing against the top of the seal 56. To insure that the platform remains securely in position and to compress the seal 56 to withstand the large hydrostatic pressures involved, a plurality of turnbuckles 58 are provided, the lower end of the turnbuckles being secured to the cellar by hooking into anchor plates 60 integrally formed with the cast cellar 24. The upper end of the turnbuckles are hooked into anchor plates 62 recessed in the bottom 13 of the drilling platform. The turnbuckles 58 are tightened to cinch the platform against the seal 56.

An alternative arrangement is shown in FIG. 12 in which a seal 66 is in the form of an annular ring of sealing material resting on top of annular metal ring 68. The seal 66 engages the bottom 13 of the drilling platform and the inside of the sidewalls of the cellar 24. A plurality of hydraulic jacks 70 resting on the bottom of the cellar 24 engage the annular metal ring 68, compressing the seal 66 between the ring 68 and the bottom 13 of the drilling platform to form a seal. In the arrangement of FIG. 12, the seal adjusts readily for misalignment between the cellar 24 after it is implanted in the bottom of the drilling platform after it is brought to rest on the ocean floor.

It will be seen that the arrangements of FIG. 11 and FIG. 12 permit the moon pool and cellar to be used as a caisson, permitting access to wellheads located in the cellar without requiring the workers to operate in diving gear.

What is claimed is:

1. A mounting structure for anchoring a monopod drilling platform to the ocean floor, comprising an open precast vessel having a bottom wall and a side wall extending up from and around the perimeter of the bottom wall, the side wall terminating in a continuous edge at the top lying in a plane, the top edge of the wall forming an opening in the top of the vessel, a monopod drilling structure having a base and a supporting column extending upwardly from the base, the column having a vertical passage opening through the bottom of the base, the base having a flat bottom surface surrounding the opening of the vertical passage, the opening of the passage being substantially smaller than the opening in the top of the vessel, the vessel being adapted to be submerged in the ocean floor with the bottom of the platform base extending across the top edge of the vessel, and sealing means secured to the vessel adjacent the top edge of the vessel and frictionally engaging the bottom of the platform to form a water-tight intersection while permitting lateral movement of the platform relative to the vessel to position the vertical passage over any selected portion of the open vessel.

2. Apparatus of claim 1 further including means anchoring the drilling structure to the vessel.

3. Offshore drilling apparatus, comprising: a vessel adapted to be anchored on the ocean floor, the vessel being open on the top, a monopod drilling platform having a submerged base, an upper deck, and column means supporting the deck from the base, means forming a vertical passage extending from the deck down through the base, the passage being open at the bottom for forming a moon pool through which a drill bit and drill stem can be lowered from the deck to the ocean floor, means for releasably attaching the base to the top of the vessel with the passage aligned with the open top of the vessel, and pressure sealing means forming a water-tight junction between the base and the vessel to exclude water from the interior of the vessel and the passage when the platform is moved into position.

4. A mounting structure for anchoring a monopod drilling platform to the ocean floor, comprising an open precast vessel having a bottom wall and a side wall extending up from and around the perimeter of the bottom wall, the side wall terminating in an edge at the top lying in a plane, a monopod drilling structure having a base and a supporting column extending upwardly from the base, the column having a vertical passage opening through the bottom of the base, the vessel being adapted to be submerged in the ocean floor with the bottom of the platform base extending across the top edge of the vessel, and sealing means adjacent the top edge of the vessel and engaging the bottom of the platform to form a water-tight intersection,. the sealing means including means mounted in the vessel for compressing the seal against the bottom of the drilling structure.

* * * * *